US007127927B2

(12) United States Patent
Chung et al.

(10) Patent No.: US 7,127,927 B2
(45) Date of Patent: Oct. 31, 2006

(54) CONTINUOUS SHEAR-DEFORMATION APPARATUS FOR CONTROLLING THICKNESS UNIFORMITY OF A METAL SHEET

(75) Inventors: Young-Hoon Chung, Seoul (KR); Jong-Woo Park, Seoul (KR)

(73) Assignee: Korea Institute of Science and Technology (KR)

( * ) Notice: Subject to any disclaimer, the term of this patent is extended or adjusted under 35 U.S.C. 154(b) by 0 days.

(21) Appl. No.: 11/188,314

(22) Filed: Jul. 25, 2005

(65) Prior Publication Data

US 2006/0112750 A1 Jun. 1, 2006

(30) Foreign Application Priority Data

Nov. 29, 2004 (KR) ..... 10-2004-0098790

(51) Int. Cl.
*B21C 23/00* (2006.01)

(52) U.S. Cl. ..... 72/262; 72/468

(58) Field of Classification Search ..... 72/10.7, 72/253.1, 256, 260, 259, 262, 285, 289, 468; 700/150, 154, 155; 164/436, 442
See application file for complete search history.

(56) References Cited

U.S. PATENT DOCUMENTS 3,719,065 A * 3/1973 Fuchs, Jr. ..... 72/16.8
5,335,527 A * 8/1994 Nagai et al. ..... 72/262
5,590,389 A * 12/1996 Dunlop et al. ..... 419/67
6,041,638 A * 3/2000 Pinomaa et al. ..... 72/262
6,634,415 B1 * 10/2003 Maddock et al. ..... 164/482
6,895,795 B1 * 5/2005 Chaudhury et al. ..... 72/262

FOREIGN PATENT DOCUMENTS

JP 2-235515 * 9/1990
JP 5-329531 * 12/1993

* cited by examiner

*Primary Examiner*—Ed Tolan
(74) *Attorney, Agent, or Firm*—Ostrolenk, Faber, Gerb & Soffen, LLP

(57) ABSTRACT

A continuous shear deformation apparatus comprises: a roller for pushing a metal sheet to be processed into dies; the dies having an inlet for introducing a metal sheet, a shear deformation zone for shear-deforming the sheet, and an exit; and a control unit for controlling a gap of the dies exit depending on the compressive stress generated at the metal sheet while the metal sheet passes through the shear deformation zone of the dies. The compressive stress generated at the metal sheet becomes constant when the metal sheet is shear-deformed, and thereby the thickness of the metal sheet is uniformly controlled in a longitudinal direction.

5 Claims, 2 Drawing Sheets

CONTINUOUS SHEAR-DEFORMATION APPARATUS FOR CONTROLLING THICKNESS UNIFORMITY OF A METAL SHEET

BACKGROUND OF THE INVENTION

1. Field of the Invention

The present invention relates to a continuous shearing apparatus controlling a thickness uniformity of a metal sheet, and more particularly, to a continuous shearing apparatus preventing a thickness of a sheet from being increased during the process, decreasing a thickness deviation of the sheet in a longitudinal direction, and performing a continuous shearing for a long sheet such as a coil.

2. Description of the Conventional Art

A continuous shearing apparatus as shown in FIG. 1, called as an equal channel angular rolling (ECAR) apparatus, includes a rolling device for supplying a metal sheet 20 to dies and deformation dies with an L-shaped passage causing shear deformation when a metal sheet is passing there through. The rolling device is composed of two rollers 10*a* and 10*b*, and the dies are composed of an upper die 30*a* and a lower die 30*b*. Screws 40*a* and 40*b* for controlling the gap of the dies are provided at a dies fixing wall 50.

A metal sheet 20 through the rollers 10*a* and 10*b* passes an inlet passage between A and B and is pushed to an exit (a passage after B), and the metal sheet receives shear-deformation. As the result of the shear deformation, the microstructure of the sheet becomes grain-refined so that the shear deformed sheet may have improved mechanical properties such as high strength, formability, etc.

However, in the conventional continuous shearing apparatus, when a sheet 20 goes from the rollers 10*a*, 10*b* to the shear deformation zone (B), compressive stress is generated by deformation resistance at the shear deformation zone. Such a compressive stress increases the thickness of the sheet which goes into the shear deformation zone. When the thickened sheet passes through the shear deformation zone, a larger resistance is caused thereby to increase the sheet thickness much more. Thus, as the shear deformation process continues, the sheet gets thicker. When the thickness of the sheet exceeds a limited gap of the dies exit (after B), the shear deformation processing cannot be performed any longer. Consequently, the conventional apparatus is not appropriate to the continuous processing for long sheets, such as coils.

SUMMARY OF THE INVENTION

Therefore, an object of the present invention is to provide a shearing apparatus with reduced compressive deformation during a shearing process.

Another object of the present invention is to provide a shearing apparatus performing a continuous shearing for a long sheet.

The present invention is to provide a continuous shearing apparatus preventing the thickness increase of a sheet by changing the gab of the dies exit depending on the stress generated when a sheet passes through a shear deformation zone in the L-shaped shear deformation dies. Consequently, the thickness of a processing sheet keeps uniform and a long sheet such as a coil can be continuously processed.

The present invention is to provide a continuous shearing apparatus with a control member for controlling a gap (or width) of dies in a thickness direction of the dies exit. The gap of the dies exit is controlled according to the compressive stress generated in the shear deformation zone by installing the control member.

To achieve these and other advantages and in accordance with the purpose of the present invention, as embodied and broadly described herein, it provides a continuous shearing apparatus comprising: a roller for pushing a metal sheet into a L-shaped shear deformation apparatus; dies having an inlet for introducing a sheet, a shear deformation zone for shear-deforming the sheet, and an exit; and a control unit for controlling the gap of the dies exit depending on a deformation resistance generated by shear deformation.

In an L-shaped shear-deformation apparatus according to the present invention, an elastic unit or a driving unit serving as a control unit is installed in the rear of dies exit, thereby to change the gap of the dies exit. Accordingly, when a sheet passes through the shear-deformation zone (part 'B' turned into an L-shape in the dies), if a processing resistance generated to the sheet is high, the gap of the dies exit gets wide thereby to reduce the deformation resistance. To the contrary, if a deformation resistance is low, the gap of the dies exit becomes narrowed thereby to increase the processing resistance. An elastic tension force from a control unit maintains the processing resistance generated to the sheet at the shear deformation zone constantly. Accordingly, a metal sheet between the roller and the dies inlet receives a constant compressive deformation and the thickness of the processed metal sheet is kept uniformly.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
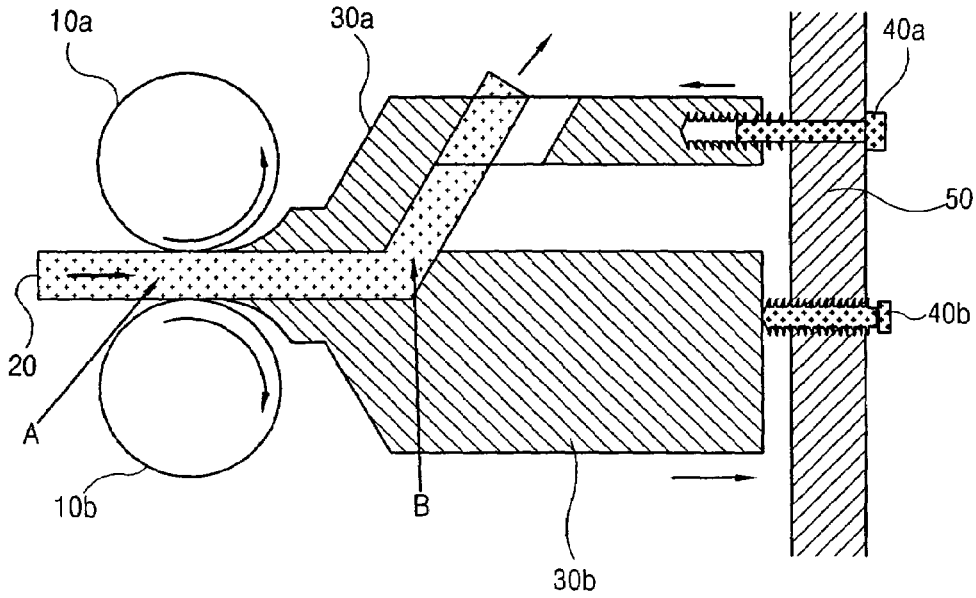
FIG. 1 CONVENTIONAL ART
FIG. 1 is a lateral section view showing a conventional continuous shearing apparatus.
Figure 2:
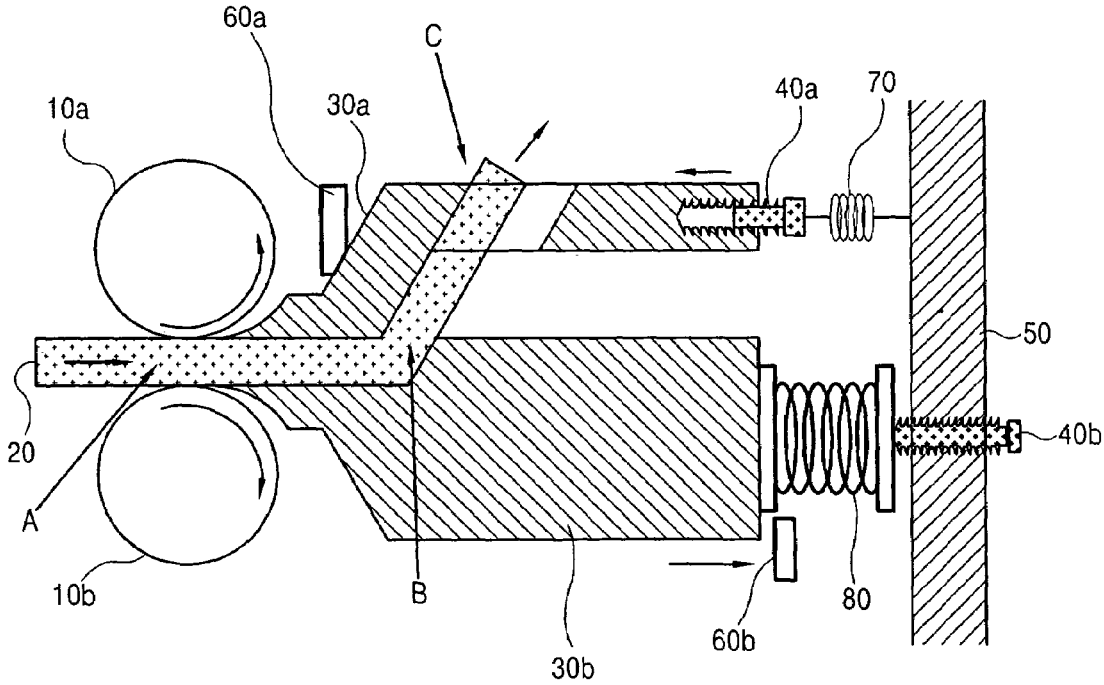
FIG. 2 is a lateral section view showing a shearing apparatus according to one embodiment of the present invention.

FIG. 2 is a lateral section view of an L-shaped shear deformation apparatus according to one embodiment of the present invention, which shows that springs are mounted at rear sides of dies.

A tension spring 70 is mounted at an upper die 30*a* so that the gap of the dies exit C can vary towards an approaching direction to the roller 10*a* when the sheet 20 is introduced into the dies exit (after B), thereby reducing a compressive resistance applied to the sheet. A compression spring 80 is mounted at a lower die 30*b* so that the gap of the dies exit can moved towards a receding direction from the roller 10*b* when the sheet 20 passes through the dies exit (after B) thereby to reduce the processing resistance generated to the metal sheet.

When the metal sheet passes through the dies exit via the shear deformation zone (part 'B'), the gap between the dies 30*a*, 30*b* can be changed automatically by an elastic tension and compression force of the springs 70 and 80 installed at the rear sides of the upper die 30*a* and the lower die 30*b*. When a processing resistance is large, the gap of the dies exit is widened thereby to lower the processing resistance. When the processing resistance becomes low, the gap of the dies exit is again narrowed thereby to keep the processing resistance constant automatically. Even if the spring is installed either at the upper die 30*a* or at the lower die 30*b*, the processing resistance becomes constant.

The upper die 30*a* and the lower die 30*b* are provided with a motion restricting unit 60*a* and 60*b* for limiting a maximum movement, respectively.

By installing the springs at the upper or lower dies, the compressive processing resistance generated when a metal sheet passes through the dies is constantly controlled. Accordingly, the thickness of a metal sheet is increased uniformly by a compressive processing resistance generated between the rollers and the shear deformation zone of the dies (between A and B), thereby having a uniform thickness in a longitudinal direction after shear deformation.

Figure 3:
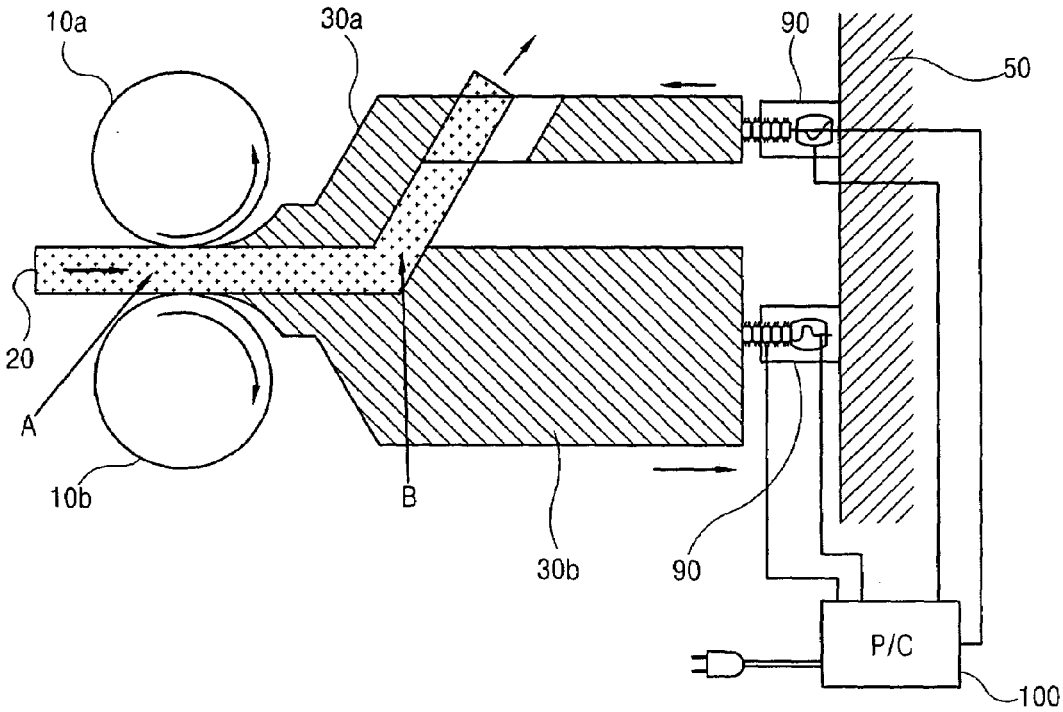
FIG. 3 is a lateral section view showing a shearing apparatus according to another embodiment of the present invention.

FIG. 3 shows still another embodiment of the present invention. Referring to FIG. 3, a driving unit 90 including a stress sensor is mounted at the rear side of the dies of the shear deformation apparatus instead of the springs in the aforementioned embodiment. The sensor detects stress changes generated from the dies exit according to processing resistance of the metal sheet 20. A detected signal is fed back to a computer 100 and the computer operates the driving unit thereby to control the gap of the dies exit. The driving unit operates to widen the dies gap when a processing stress more than a preset value is generated, while it operates to narrower the dies gap when the stress generated to the sheet is restored to the preset level while the sheet is processed.

The metal sheet 20 pushed into the dies by the rollers 10*a* and 10*b* receives a constant compressive stress, and the thickness increase of the metal sheet is uniformly controlled between the roller and the shear deformation zone. Also, the thickness of the sheet in the longitudinal direction after the shear deformation becomes uniform.

Referring to FIG. 3, in case of processing the sheet with a fast speed, further expensive devices having a fast control speed are required in order to reduce a time delay among the pressure sensor, the driving unit, and the control computer. In the present invention according to another embodiment, a driving module with a semiconductor chip containing a program for synchronously controlling a processing cycle and a driving cycle may be used. Synchronously controlling means to control the processing pressure, the operational direction, and the operation amount of the driving unit so that the driving unit can operate to widen the dies gap when a processing pressure more than a preset value is generated and the driving unit can operate to narrower the dies gap when the processing pressure is restored to the preset value.

Figure 4:
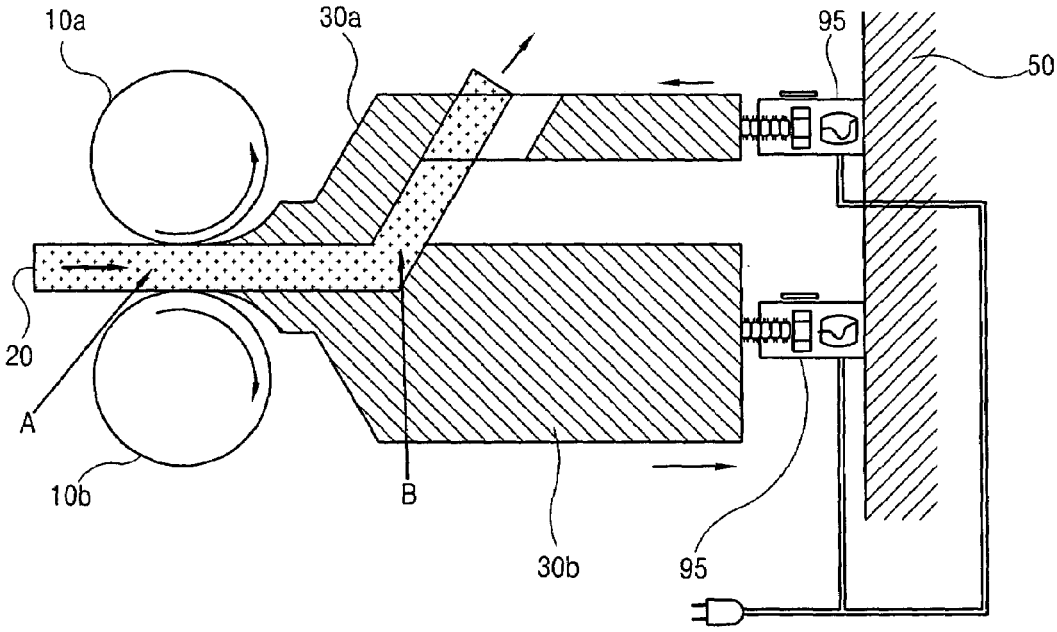
FIG. 4 is a lateral section view showing a shearing apparatus according to still another embodiment of the present invention.

As shown in FIG. 4, a driving module 95 is installed at a rear side of the dies. The module 95 is modularized to include a semiconductor chip having data for changing the processing stresses and proper dies gaps, programs of driving unit control, The module 95 also includes a driving unit, and a stress sensor. By using the driving module, the apparatus cost can be lowered and uniformity of the sheet thickness can be controlled even at a fast speed processing.

As aforementioned, in the present invention, the metal sheet 20 that has been pushed into the dies by the rollers 10*a* and 10*b* maintains a constant processing resistance, so that the thickness increase of the sheet due to the compressive deformation between the rollers and the shear deformation zone becomes uniform. Also, the thickness of the sheet in the longitudinal direction after the shear deformation is uniformly controlled, thereby to enable a consecutive shear deformation.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A continuous shear-deformation apparatus comprising:

a pair of rollers for pushing a metal sheet to be processed into deformation dies;

the dies composed of a pair of upper and lower dies, and having an inlet for introducing a metal sheet, a shear deformation zone for shear-deforming the metal sheet, and an exit; and a control unit for controlling a gap of the dies exit depending on a compressive stress generated to the metal sheet while the sheet passes through the shear deformation zone of the dies.

2. The apparatus of claim 1, wherein the control unit is an elastic unit installed at a rear side of at least one of the upper and lower dies.

3. The apparatus of claim 2, wherein the control unit is composed of a tension spring installed at a rear side of the upper die and a compression spring installed at a rear side of the lower die.

4. The apparatus of claim 1, wherein the control unit includes a stress sensor and a driving unit installed at a rear side of at least one of the upper and lower dies.

5. The apparatus of claim 4, wherein the control unit is a driving module having a stress sensor, a driving unit, and a semiconductor chip for controlling the gap of the dies exit.

* * * * *